US007614905B2

(12) United States Patent
Shen et al.

(10) Patent No.: US 7,614,905 B2
(45) Date of Patent: Nov. 10, 2009

(54) MODULAR JACK

(75) Inventors: Hui-Juan Shen, Kunshan (CN); Qing Wan, Kunshan (CN); Li-Chun Wu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/286,310

(22) Filed: Sep. 29, 2008

(65) Prior Publication Data

US 2009/0093154 A1 Apr. 9, 2009

(30) Foreign Application Priority Data

Oct. 9, 2007 (CN) ..... 2007 2 0043550 U

(51) Int. Cl.
*H01R 3/00* (2006.01)

(52) U.S. Cl. ..... 439/490; 439/676

(58) Field of Classification Search ..... 439/490, 439/676, 540.1, 939, 941

See application file for complete search history.

(56) References Cited

U.S. PATENT DOCUMENTS 6,962,511 B2 * 11/2005 Gutierrez et al. ..... 439/676
7,234,964 B1 * 6/2007 Karstens ..... 439/490

FOREIGN PATENT DOCUMENTS

CN 2588614 11/2003

* cited by examiner

*Primary Examiner*—Khiem Nguyen
(74) *Attorney, Agent, or Firm*—Ming Chieh Chang; Wei Te Chung; Andrew C. Cheng

(57) ABSTRACT

A modular jack (100) for receiving a mating plug includes a visual indicator (3) having a lighting pipe (31), a pair of pins (32) extending from the lighting pipe and a separate guiding pipe (33), and an insulative housing (1) including a front face (1), an opposite rear face (13), side faces (12) connecting with the front face and rear face. The insulative housing defines a pipe slot (152) extending through the front face and the side face for receiving the guiding pipe, and further has a receiving channel (152) in communication with the pipe slot for receiving the lighting pipe and a number of pin slots (151) extending rearwardly and through the rear face of the housing for receiving the pins.

7 Claims, 6 Drawing Sheets

MODULAR JACK

BACKGROUND OF THE INVENTION

1. Field of the Invention

The present invention relates to a modular jack, and particularly to a modular jack having a visual indicator and an insulative housing for retaining the visual indicator.

2. Description of Prior Arts

A conventional modular jack is described in Chinese Patent No. CN2588614 issued on Nov. 26, 2003. The modular jack includes a visual indicator such as LED for indicating a condition of an electrical signal, an insulative housing having a front wall and a top wall, a printed circuit board mounted into the insulative housing. The insulative housing has a pair of receiving channels defined between the front wall, an opposite rear wall, a top wall and a plurality of pin slots extending through the rear wall and in communication with the pin slots. The visual indicator comprises a plurality of lighting pipes retained in the receiving channel and long pins extending from the lighting pipe and received in the pin slots.

During assembly, it is difficult to mount the long pins into receiving channel and apt to cause a crack of the long pins.

Hence, it is desirable to provide an improved modular jack to overcome the aforementioned disadvantages.

SUMMARY OF THE INVENTION

An object of the present invention is to provide a modular jack having an insulative housing defining a receiving channel and a pipe slot for easily inserting of a visual indicator.

To achieve the above object, a modular jack for receiving a mating plug comprises a visual indicator, an insulative housing comprising a front face, an opposite rear face, side faces connecting with the front face and rear face, and a receiving space for engaging with the mating plug, and a terminal module comprising a plurality of terminals received in the receiving space. The visual indicator comprises a lighting pipe, a pair of pins extending from the lighting pipe, and a separate guiding pipe. The insulative housing defines a pipe slot extending through the front face and the side face for receiving the guiding pipe, and further comprises a receiving channel in communication with the pipe slot for receiving the lighting pipe and a plurality of pin slots extending rearwardly and through the rear face of the housing for receiving the pins.

Advantages of the present invention are to provide an insulative housing defining a receiving channel for receiving the lighting pipe and a pipe slot in communicating with the receiving channel for retaining a separate pipe. Therefore, it is easy to insert the visual indicator into the insulative housing and effective to avoid a damage of the pins of the visual indicator.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
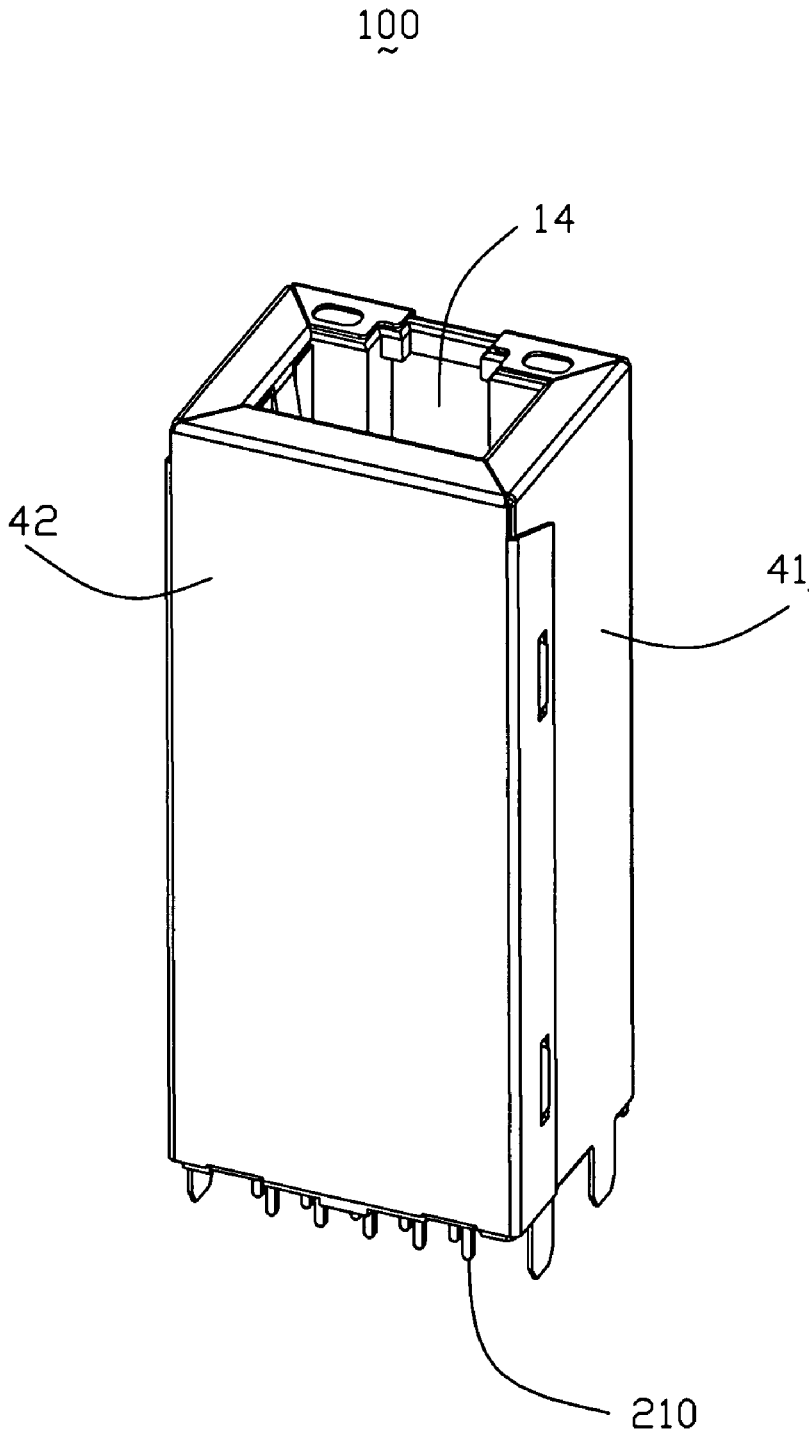
FIG. 1 is an assembled perspective view of a modular jack according to the present invention.
Figure 2:
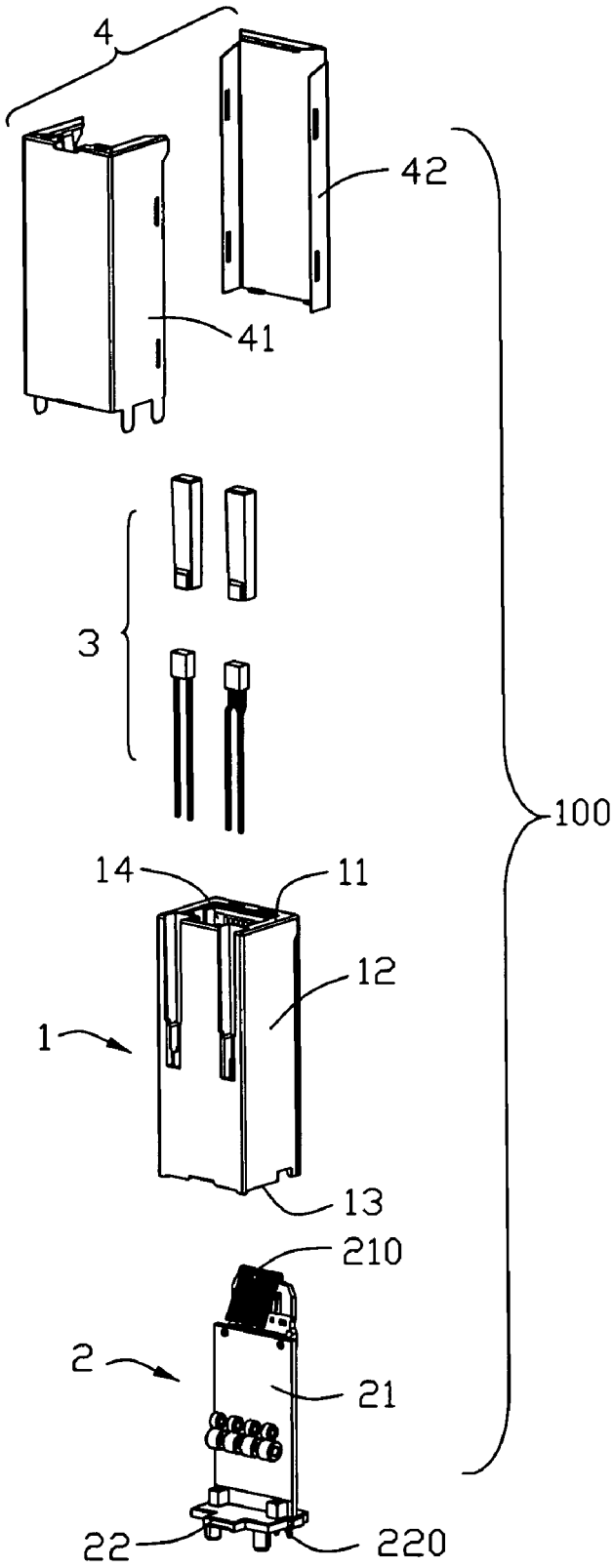
FIG. 2 is an exploded view of the modular jack as shown in FIG. 1.
Figure 3:
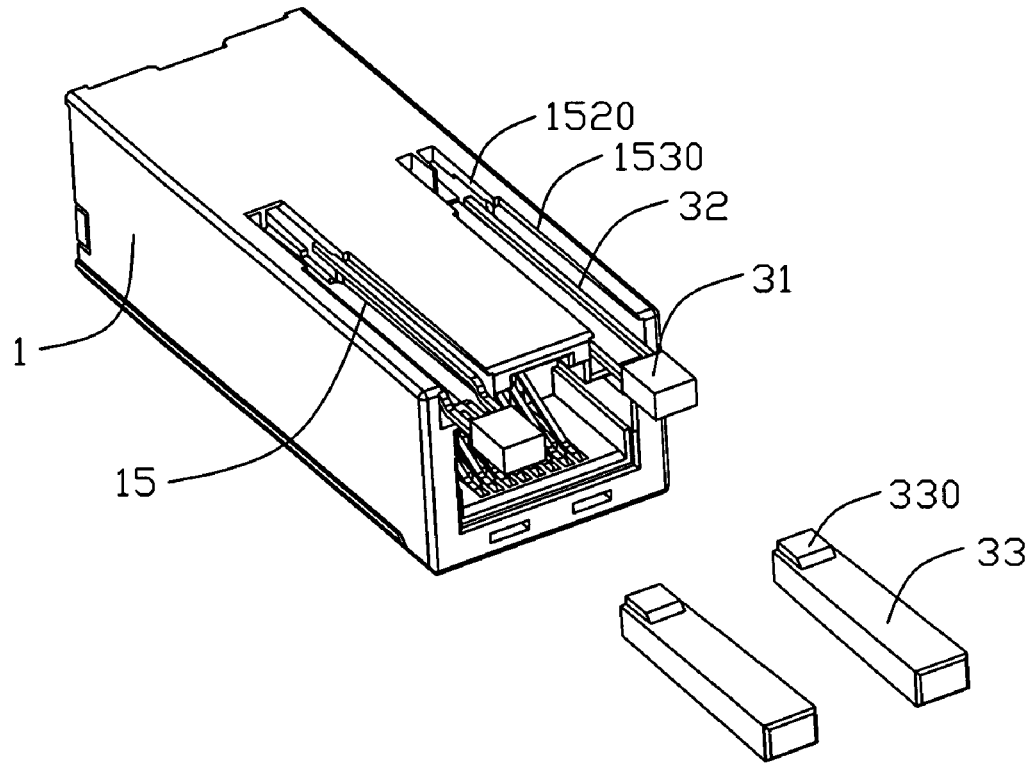
FIG. 3 is a perspective view of an insulative housing with a pair of visual indicators and a terminal module mounted thereto.
Figure 4:
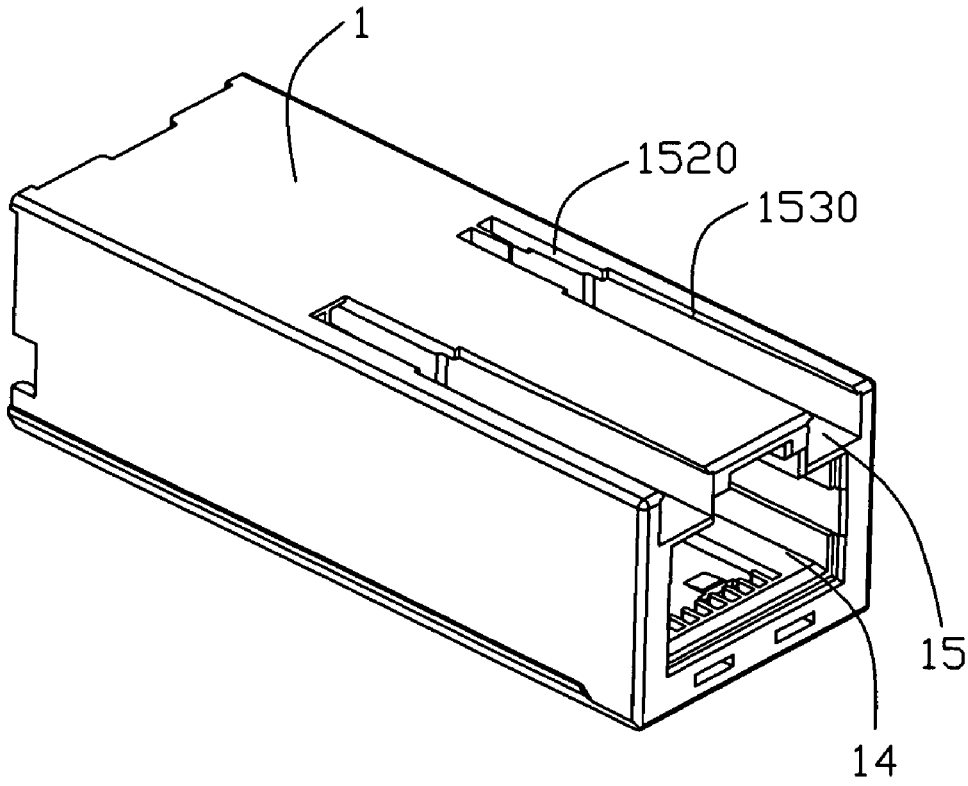
FIG. 4 is a perspective view of the insulative housing.
Figure 5:
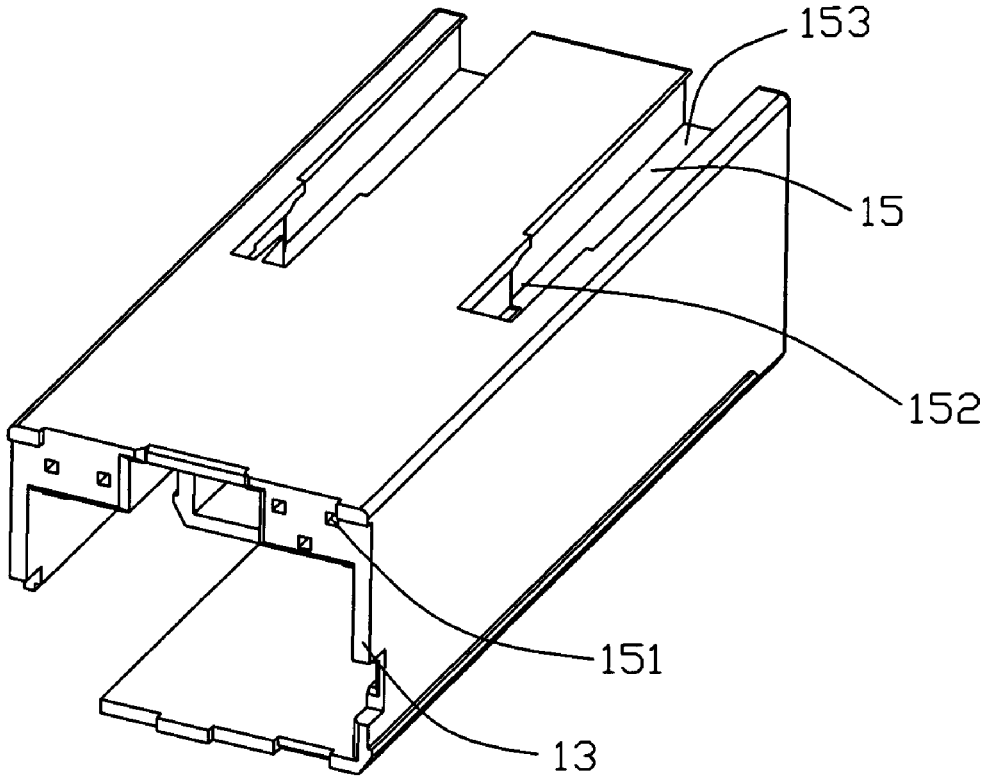
FIG. 5 is another perspective view similar to FIG. 4, taken from a rearward aspect.
Figure 6:
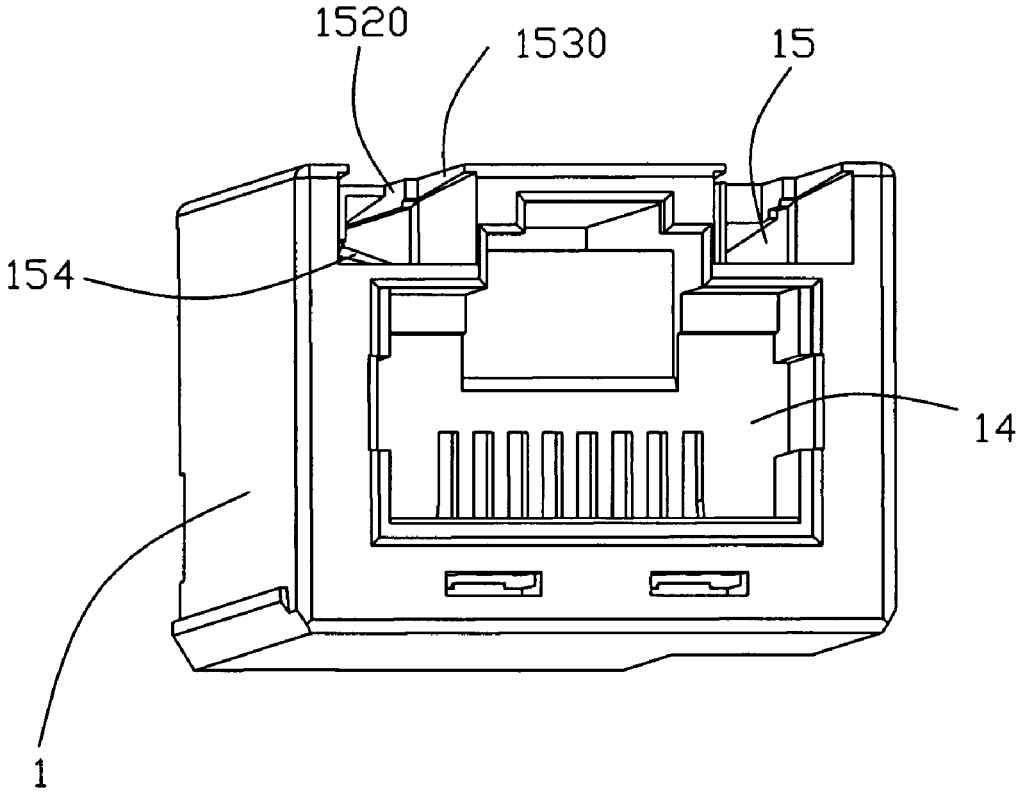
FIG. 6 is another perspective view similar to FIG. 4, taken from a forward aspect.

Reference will now be made to the drawing figures to describe the present invention in detail. Referring to FIGS. 1-5, a modular jack 100 adapted for engaging with a mating plug (not shown) in accordance with the present invention comprises an insulative housing 1, a terminal module 2 mounted to the insulative housing 1, a pair of visual indicators 3 and a conductive outer shield 4 enclosing the insulative housing 1.

The visual indicator 3 indicating a condition of an electrical signal comprises a lighting pipe 31, a pair of pins 32 extending from the lighting pipe 31, and a separate guiding pipe 33.

Referring to FIGS. 2-5, the insulative housing 1 has a front face 11, an opposite rear face 13, side faces 12 connecting with the front face 11 and rear face 13, and a receiving space 14 for engaging with the mating plug. The insulative housing 1 defines a pipe slot 153 extending through the front face 11 and the side face 12 for receiving the guiding pipe 33, and further comprises a receiving channel 152 in communication with the pipe slot 153 for receiving the lighting pipe 31 and a plurality of pin slots 151 extending rearwardly and through the rear face 13 of the housing 1 for receiving the pins 32. The insulative housing 1 comprises a first protruding wall 1530 extending from the inner surface of the pipe slot 153 and into the pipe slot 153 and a second protruding wall 1520 extending from the inner surface of the receiving channel 152 and into the receiving channel 152. The lighting pipe 31 is retained between the second protruding wall 1520 and a bottom surface of the receiving channel 152. The guiding pipe 33 is retained between the first protruding wall 1530 and a bottom surface of the pipe slot 153. A slantwise section 154 is disposed on the bottom surface of the receiving channel 152 for guiding the pins 32 into the corresponding pin slots 151.

The terminal module 2 comprises a printed circuit board 21, a plurality of terminals 210 mounted to a top portion of the printed circuit board 21 and received in the receiving space 14 for electrically connecting with the mating plug, and a connecting section 22 mounted to a bottom portion of the printed circuit board 21 and a plurality of second contacts 220 assembled to the connecting section 22 and extending downwardly for connecting with a mother printed circuit board (not shown).

The outer shield 4 has a top outer shield 41 and a lower outer shield 42. The top outer shield 41 has a plurality of recesses 410 defined on side portions thereof for mating with corresponding protrusions 420 disposed on side portions of the lower outer shield 42.

In assembling, firstly, the terminal module 2 is mounted to the insulative housing 10, the terminals 210 are received in the receiving spaces 14. Secondly, the lighting pipe 31 is mounted into the receiving channel 152 by the guiding of the slantwise section 154. At that time, the number of pins 32 extending through the pin slots 151 for connecting with the mother printed circuit board. The guiding pipe 33 is mounted into the pipe slot 153 and provided with a rib 330 disposed on a top surface thereof and resisting against the second protruding wall 1520. Finally, the top outer shield 41 and the lower outer shield 42 enclose the insulative housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack for receiving a mating plug, comprising: a visual indicator for indicating a condition of an electrical signal, the visual indicator comprising a lighting pipe, a pair of pins extending from the lighting pipe, and a separate guiding pipe; an insulative housing comprising a front face, an opposite rear face, side faces connecting with the front face and rear face, and a receiving space for engaging with the mating plug, wherein said insulative housing defines a pipe slot extending through the front face and the side face for receiving the holding pipe, a receiving channel in communication with the pipe slot for receiving the lighting pipe, and a plurality of pin slots extending rearwardly and through the rear face of the housing for receiving the pins; and a terminal module comprising a plurality of terminals received in the receiving space, wherein said insulative housing comprises a second protruding wall extending from the inner surface of the receiving channel into the receiving channel, and wherein the lighting pipe is retained between the second protruding wall and a bottom surface of the receiving channel, further comprising a conductive outer shield enclosing the insulative housing.

2. The modular jack as claimed in claim 1, wherein said insulative housing comprises a first protruding wall extending from the inner surface of the pipe slot into the pipe slot, and wherein the guiding pipe is retained between the first protruding wall and a bottom surface of the pipe slot.

3. The modular jack as claimed in claim 1, wherein said guiding pipe comprises a rib disposed on a top surface thereof and resisting against the second protruding wall.

4. The modular jack as claimed in claim 1, wherein said insulative housing comprises a slantwise section disposed on the bottom surface of the receiving channel for guiding the pins into the corresponding pin slots.

5. The modular jack as claimed in claim 1, wherein said terminal module comprises a printed circuit board, and a plurality of contacts mounted to a rear section of the printed circuit board.

6. An electrical connector comprising: an insulative housing defining a plug receiving cavity with a plurality of contacts extending thereinto; a pair of pipe slots formed beside while isolated from said plug receiving cavity; a pair of receiving channels communicatively aligned with the pair of pipe slots; a pair of pin slot sets communicatively aligned with the pair of receiving channels; a pair of pin sets received in the corresponding pair of pin slots sets, respectively; a pair of lighting pipes integrally formed with the corresponding pair of pin sets and received in the corresponding receiving channels, respectively; and a pair of guiding pipes discrete from while intimately engaged with the corresponding pair of lighting pipes, respectively, wherein both said receiving channel and the pipe slot extend through the housing sidewall while being covered by a metallic shell.

7. The electrical connector as claimed in claim 6, wherein said receiving channel is smaller than the pipe slot, and the pin slot set is smaller than the receiving channel.

* * * * *